US006172618B1

(12) United States Patent
Hakozaki et al.

(10) Patent No.: US 6,172,618 B1
(45) Date of Patent: Jan. 9, 2001

(54) ETC CAR-MOUNTED EQUIPMENT

(75) Inventors: Hirotoshi Hakozaki; Shimon Okada, both of Tokyo (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/309,786

(22) Filed: May 12, 1999

(30) Foreign Application Priority Data

Dec. 7, 1998 (JP) ..... 10-347107

(51) Int. Cl.[7] ..... G08G 1/00
(52) U.S. Cl. ..... 340/928; 340/461; 705/13
(58) Field of Search ..... 340/461, 928; 705/13

(56) References Cited

U.S. PATENT DOCUMENTS 5,525,991 * 6/1996 Nagura et al. ..... 340/825.54
6,095,840 * 8/2000 Yamaguchi et al. ..... 439/247

FOREIGN PATENT DOCUMENTS 8-297758 11/1996 (JP) .

* cited by examiner

*Primary Examiner*—Daniel J. Wu
(74) *Attorney, Agent, or Firm*—Sughrue, Mion, Zinn, Macpeak & Seas, PLLC

(57) ABSTRACT

An ETC car-mounted equipment which can be attached to an existing room mirror in a vehicle and enhances operability for inputting the data impairing neither the communication function nor the visual range for operation. An ETC car-mounted equipment exchanges ETC data relative to an ETC road equipment, and comprises a main body 13 of the car-mounted equipment having a display unit for displaying the ETC data, an IC card insertion port 16 formed in the main body of said car-mounted equipment and in which will be inserted an IC card that stores said ETC data, a mirror unit 14 provided on the front surface of the main body of said car-mounted equipment, an antenna unit 15 provided on the back surface side of the main body of said car-mounted equipment, and resilient holding units 21 for holding the main body of said car-mounted equipment on a room mirror in the vehicle integrally therewith.

11 Claims, 5 Drawing Sheets

ETC CAR-MOUNTED EQUIPMENT

BACKGROUND OF THE INVENTION

1. Field of the Invention

The present invention relates to an ETC (electronic toll collection system) car-mounted equipment having a mirror unit. More particularly, the invention relates to an ETC car-mounted equipment which can be attached to an existing room mirror in a vehicle and enhances operability impairing neither the communication function nor the visual range for operation.

2. Prior Art

An electronic toll collection system called ETC has heretofore been known, and an ETC car-mounted equipment has been known too, the ETC equipment being mounted on a vehicle to exchange the data related to the balance and toll (hereinafter referred to as "ETC data") relative to an ETC road equipment.

The ETC car-mounted equipment has an antenna unit which includes an antenna element and an RF substrate, and must be installed at such a position in a vehicle where the communication function can be maintained between the antenna unit and the ETC road equipment without impairing the visual range for operation.

Japanese Unexamined Patent Publication (Kokai) No. 297758/1996 discloses an ETC car-mounted equipment having a mirror unit, which is incorporated in a room mirror in the vehicle as a unitary structure.

FIG. 10 is a perspective view schematically illustrating the constitution of a conventional ETC car-mounted equipment having a mirror unit.

In FIG. 10, a main body 3 of the ETC car-mounted equipment is attached, via a stay (not shown), to a roof 2 in the room of a vehicle so as to be located at an upper part of a windshield 1 of the vehicle.

The main body 3 of the car-mounted equipment includes a mirror unit 4 provided on the upper surface of a front closure that can be opened and closed, an antenna unit 5 provided on the back surface side, an IC card insertion port 6 in which will be inserted an IC card 10 for storing ETC data, a display unit 7 for displaying ETC data, a key switch 8 including ten keys for inputting data, and a buzzer 9 for alarming abnormal condition.

In the constitution of FIG. 10, the IC card 10 is inserted in the IC card insertion port 6 of the main body 3 of the car-mounted equipment, whereby the specific ETC data are read out to specify a person who uses the vehicle and the ETC car-mounted equipment.

Therefore, the ETC car-mounted equipment functions preventing the chances of being used without authorization, and the antenna unit 5 executes communication with the ETC road equipment (not shown) installed at a toll gate of a toll road. Accordingly, a toll for using the road is automatically collected and settled based upon a wireless communication.

Here, the main body 3 of the car-mounted equipment in which the IC card 10 will be inserted, is incorporated in the existing room mirror as a unitary structure. When the front closure is closed, the mirror unit 4 serves as a room mirror without interrupting the visual range for operation.

To input the data or command, the driver opens the front closure having the mirror unit 4 and manipulates the key switch 8 to input any data or command.

As described above, the conventional ETC car-mounted equipment has been constituted together with the room mirror as a unitary structure. Therefore, the ETC car-mounted equipment must be incorporated at the time when the vehicle is being assembled in a plant. In other words, it is difficult to attach the ETC car-mounted equipment after the vehicle has been assembled. Depending upon the models of vehicles, furthermore, the directivity of the antenna unit 5 is not often set in an optimum manner.

To input the data, furthermore, the front closure fabricated together with the mirror unit 4 must be opened; i.e., the data are not easily input and, besides, the mirror unit 4 does not function while it is being opened.

SUMMARY OF THE INVENTION

The present invention was accomplished in order to solve the above-mentioned problems, and its object is to provide an ETC car-mounted equipment which can be attached to the existing room mirror in a vehicle and which can be favorably operated to input data impairing neither the communication function nor the visual range for operation.

The present invention is concerned with an ETC car-mounted equipment for exchanging ETC data relative to an ETC road equipment, comprising:

- a main body of the car-mounted equipment having a display unit for displaying the ETC data;
- an IC card insertion port formed in the main body of said car-mounted equipment and in which will be inserted an IC card that stores said ETC data;
- a mirror unit provided on the front surface of the main body of said car-mounted equipment;
- an antenna unit provided on the back surface side of the main body of said car-mounted equipment; and
- resilient holding units for holding the main body of said car-mounted equipment on a room mirror in said vehicle integrally therewith.

The invention is further concerned with an ETC car-mounted equipment, wherein the main body of said car-mounted equipment has holder rubbers which are disposed being opposed to said resilient holding units to hold said room mirror.

The invention is further concerned with an ETC car-mounted equipment, further comprising a burglarproof mechanism for securing the main body of said car-mounted equipment to the room mirror.

The invention is further concerned with an ETC car-mounted equipment, wherein said burglarproof mechanism includes openings formed in the main body of said car-mounted equipment and a burglarproof metal fitting, and said burglarproof metal fitting includes:

- a mirror stay-engaging portion that engages with the stay of said room mirror;
- protuberances inserted in the openings of the main body of said car-mounted equipment; and
- locking pawls provided at portions of said protuberances to engage with said openings.

The invention is further concerned with an ETC car-mounted equipment, wherein said mirror stay-engaging portion has a U-shape of which the width can be variably set depending upon the shape of said stay.

The invention is further concerned with an ETC car-mounted equipment, wherein the openings in the main body of said car-mounted equipment produce resiliency in the opening/closing direction, and the state of engagement between the locking pawls of said burglarproof metal fitting and the openings in the main body of said car-mounted equipment, is liberated by inserting a special jig in said openings.

The invention is further concerned with an ETC car-mounted equipment, wherein the protuberances of said burglarproof metal fitting comprise a pair of protuberances that produce resiliency toward the inside, said locking pawls are provided on the inside only of each of said pair of protuberances, and the state of engagement between the locking pawls of said burglarproof metal fitting and the openings in the main body of said car-mounted equipment, is liberated by inserting a special jig between said pair of protuberances.

The invention is further concerned with an ETC car-mounted equipment, wherein an antenna-mounting portion for mounting said antenna unit on the main body of said car-mounted equipment, includes an antenna angle-adjusting mechanism for adjusting the direction of communication of said antenna unit.

The invention is further concerned with an ETC car-mounted equipment, wherein said antenna angle-adjusting mechanism includes at least a front direction angle-adjusting shaft and a side direction angle-adjusting shaft for turning the communication plane of said antenna unit in the directions of a plurality of axes with respect to the direction in which the vehicle travels.

The invention is further concerned with an ETC car-mounted equipment, wherein said display unit is arranged at a lower part on the front surface of the main body of said car-mounted equipment, and has key switches on both sides thereof for inputting the data.

The invention is further concerned with an ETC car-mounted equipment, wherein the main body of said car-mounted equipment has a hole through which a reflection-preventing lever of said room mirror protrudes so as to be operated.

DESCRIPTION OF THE PREFERRED EMBODIMENTS

Embodiment 1.

An embodiment 1 of the present invention will now be described with reference to the drawings.

Figure 1:
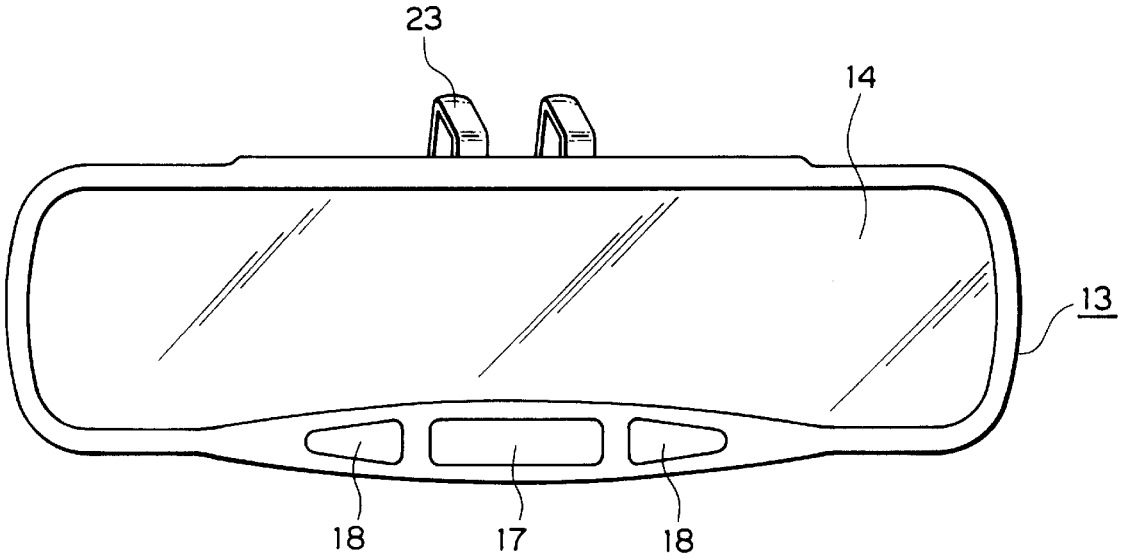
FIG. 1 is a front view illustrating an embodiment 1 according to the present invention.
Figure 2:
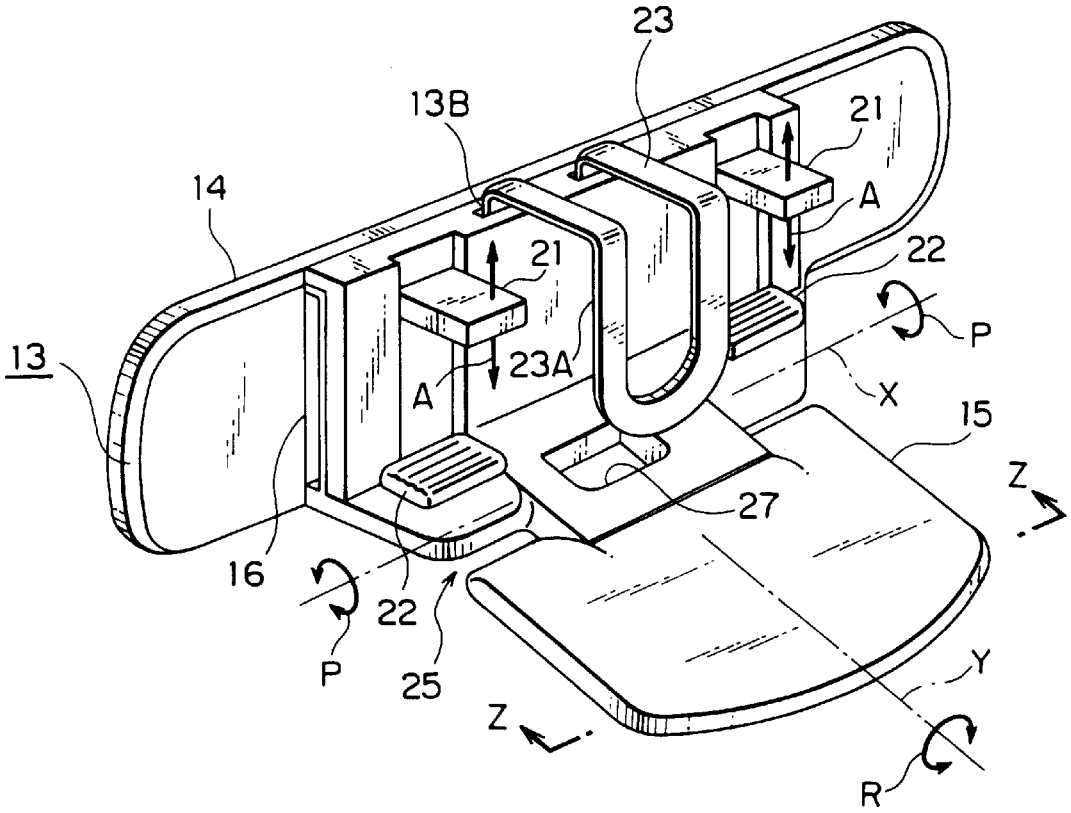
FIG. 2 is a perspective view of when an embodiment 1 of the present invention is viewed from the side of the back surface.

FIG. 1 is a front view illustrating the embodiment 1 of the present invention, and FIG. 2 is a perspective view of when the embodiment 1 of the present invention is viewed from the side of the back surface.

Figure 3:
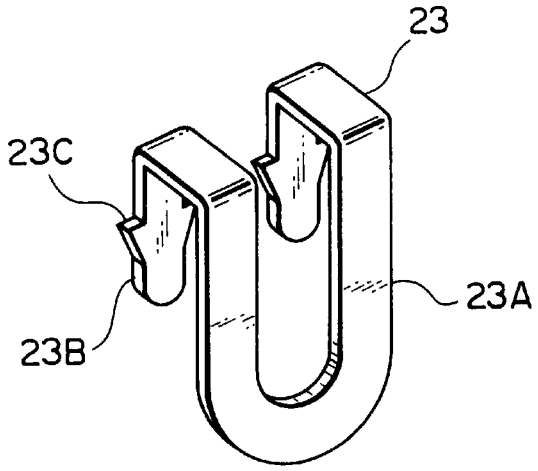
FIG. 3 is a perspective view illustrating a burglarproof metal fitting according to an embodiment 1 of the present invention.
Figure 4:
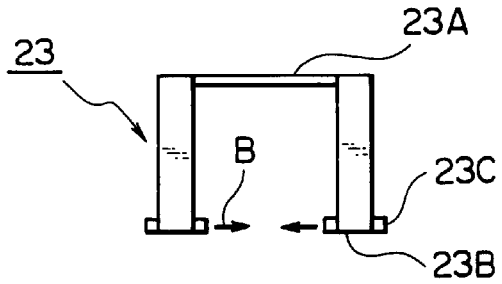
FIG. 4 is a plan view illustrating the burglarproof metal fitting according to an embodiment 1 of the present invention.
Figure 5:
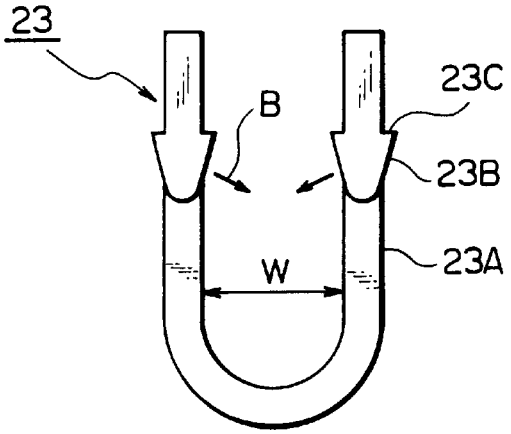
FIG. 5 is a front view illustrating the burglarproof metal fitting according to an embodiment 1 of the present invention.
Figure 6:
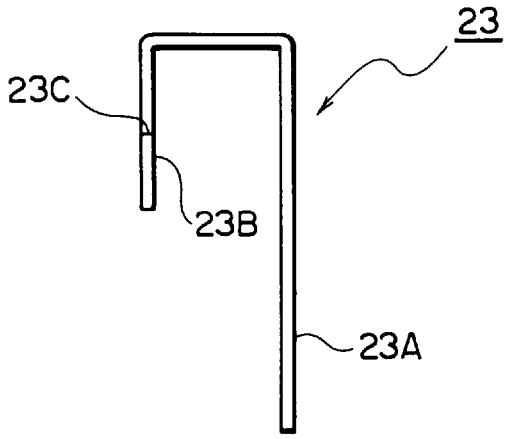
FIG. 6 is a side view illustrating the burglarproof metal fitting according to an embodiment 1 of the present invention.
Figure 7:
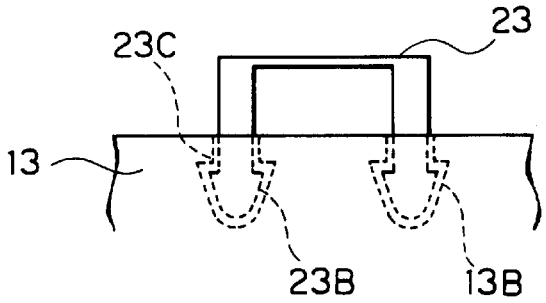
FIG. 7 is a partial front view illustrating a state where the burglarproof metal fitting according to an embodiment 1 of the present invention is inserted in a main body of a car-mounted equipment.

FIGS. 3 to 6 illustrate a burglarproof metal fitting used for the embodiment 1 of the present invention, wherein FIG. 3 is a perspective view, FIG. 4 is a plan view, FIG. 5 is a front view and FIG. 6 is a side view. FIG. 7 is a front view illustrating a burglarproof mechanism according to the embodiment 1 of the present invention.

Figure 8:
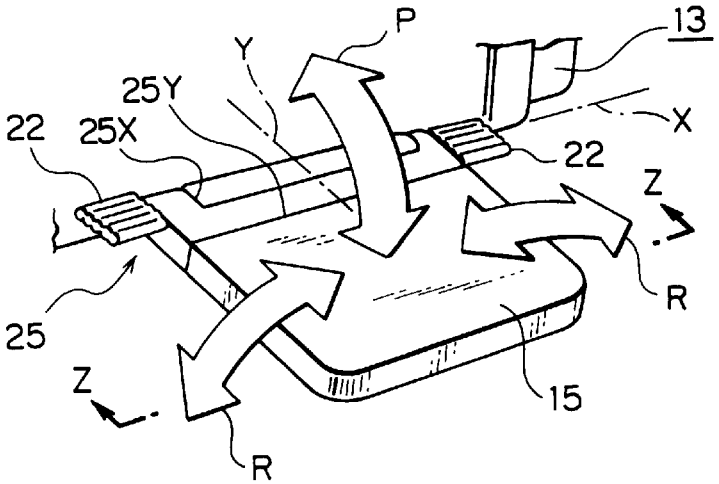
FIG. 8 is a perspective view illustrating an antenna unit and an antenna-mounting portion according to an embodiment 1 of the present invention.
Figure 9:
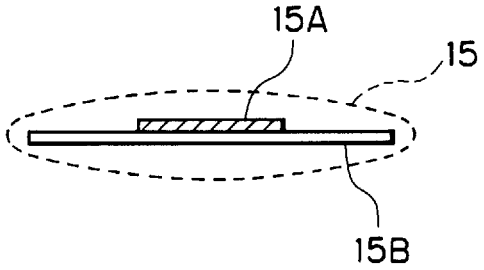
FIG. 9 is a sectional view of the antenna unit along the line Z—Z in FIGS. 2 and 8 according to an embodiment 1 of the present invention.

FIG. 8 is a perspective view illustrating an antenna-mounting portion according to the embodiment 1 of the present invention, and FIG. 9 is a side sectional view of the antenna portion along the line Z—Z in FIG. 8.

Figure 10:
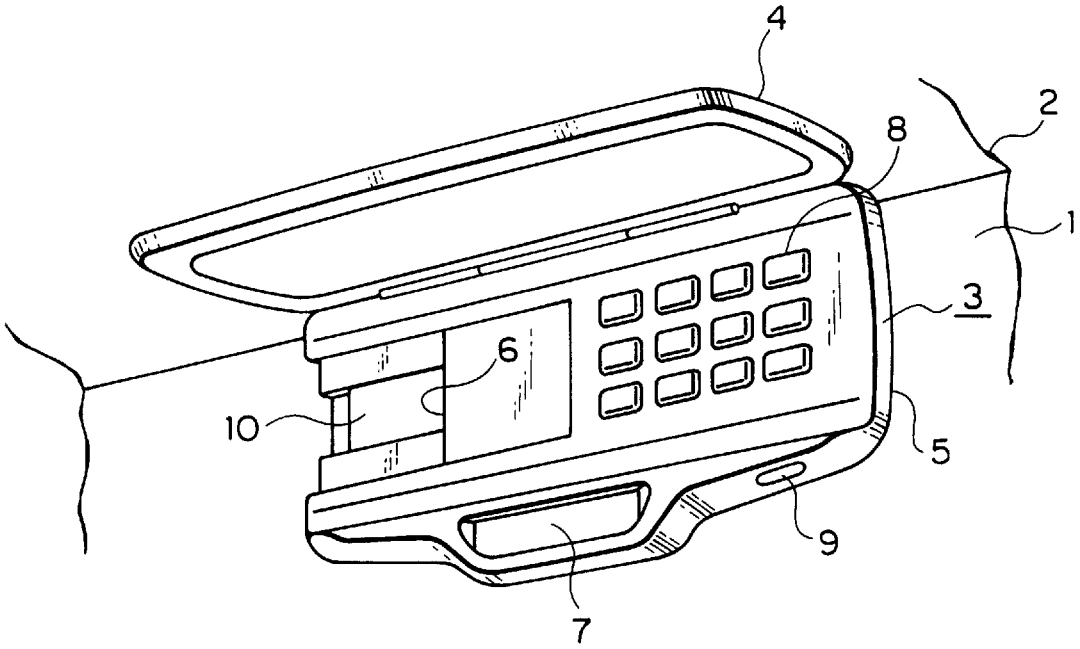
FIG. 10 is a perspective view illustrating a conventional ETC car-mounted equipment.

In these drawings, a main body 13 of the car-mounted equipment, a mirror unit 14, an antenna unit 15, an IC card insertion port 16, a display unit 17 and a key switch 18 correspond to the above-mentioned main body 3 of car-mounted equipment, mirror unit 4, antenna unit 5, IC card insertion port 6, display unit 7 and key switch 8 (see FIG. 10).

Here, the IC card 10, windshield 1 of the vehicle and roof 2 in the room are the same as those described above (see FIG. 10), and are not diagramed.

In this embodiment, the mirror unit 14 is provided on the front surface of the main body 13 of the car-mounted equipment, and the antenna unit 15 and the IC card insertion port 16 are arranged on the back surface side of the main body 13 of the car-mounted equipment.

The display unit 17 is arranged at a lower part on the front surface of the main body 13 of the car-mounted equipment, and has key switches 18 on both sides for inputting the data.

The main body 13 of the car-mounted equipment is equipped with plate-like resilient holding units 21 producing resiliency in the direction of an arrow A and plate-like holder rubbers 22 arranged being opposed to the resilient holding units 21.

Here, the resilient holding units 21 and the holder rubbers 22 are provided each in a pair. They, however, may be provided in any required numbers.

The resilient holding units 21 and the holder rubbers 22 work to hold the existing room mirror relying upon the resiliency in the up-and-down direction, enabling the main body 13 of the car-mounted equipment to be held by the room mirror integrally therewith.

Openings 13B are formed in the upper end surface of the main body 13 of the car-mounted equipment to constitute a burglarproof mechanism for the ETC car-mounted equipment together with a burglarproof metal fitting 23.

Due to the burglarproof metal fitting 23, the main body 13 of the car-mounted equipment is detachably secured to the room mirror.

Referring to FIGS. 3 to 6, the burglarproof metal fitting 23 includes a U-shaped mirror stay-engaging portion 23A that engages with a stay of the room mirror, protuberances 23B inserted in the openings 13B of the main body 13 of the car-mounted equipment, and locking pawls 23C formed on portions of the protuberances 23B to engage with the openings 13B.

The pair of protuberances 23B of the burglarproof metal fitting 23 may produce resiliency in the directions of arrows B (toward the inside) as shown in FIGS. 4 and 5.

The U-shaped mirror stay-engaging portion 23A has a width W (see FIG. 5) that can be variously set depending upon the shape of the stay (varies depending upon the model of the vehicle), and is so constituted as can be engaged depending upon the model of the vehicle.

The openings 13B in the main body 13 of the car-mounted equipment and the protuberances 23B of the burglarproof metal fitting 23 are engaged with each other via the locking pawls 23C in a manner as shown in FIG. 7.

Furthermore, the openings 13B produce resiliency in the opening/closing direction, and are expanded by inserting a special jig (not shown).

Therefore, the state where the locking pawls 23C and the openings 13B are engaged with each other, is liberated by inserting the special jig in the openings 13B, enabling the main body 13 of the car-mounted equipment to be removed from the room mirror as required.

In FIG. 2, the antenna-mounting portion 25 that connects the main body 13 of the car-mounted equipment to the antenna unit 15, includes an antenna angle-adjusting mechanism for adjusting the direction of communication of the antenna unit 15.

In order that the communication plane of the antenna unit 15 can be turned in the directions of a plurality of axes with respect to the direction in which the vehicle travels, the antenna angle-adjusting mechanism possesses, as shown in FIG. 8, at least two rotary shafts or a front-direction angle-adjusting shaft X and a side-direction angle-adjusting shaft Y at two motion connection portions 25X and 25Y.

The front-direction angle-adjusting shaft X permits the antenna unit 15 to be turned in the direction of an arrow P at the motion connection portion 25X, and the side-direction angle-adjusting shaft Y permits the antenna portion 15 to be turned in the direction of an arrow R at the motion connection portion 25Y.

Referring to FIG. 9, the antenna unit 15 includes an antenna element 15A disposed on the upper surface side of the antenna unit 15 and an RF substrate 15B arranged on the lower surface side of the antenna unit 15.

In general, the ETC road equipment is disposed in the air at a high position at a toll gate of a toll road. It is therefore desired that the antenna element 15A that executes communication with the ETC road equipment is directed toward the upper side as shown in FIG. 9.

The RF substrate 15B is provided with a reception processing circuit.

In FIG. 2, furthermore, the main body 13 of the car-mounted equipment has a hole 27 through which a reflection-preventing lever (not shown) of the room mirror protrudes so as to be operated.

In the ETC car-mounted equipment constituted as shown in FIGS. 1 to 9, the mirror unit 14 provided on the front surface of the main body 13 of the car-mounted equipment normally functions at all times like the existing room mirror.

Furthermore, the key switches 18 provided on the front surface of the main body 13 of the car-mounted equipment can be easily operated as required.

By using the pair of key switches 18 on both sides of the display unit 17, in this case, the ten-key functions and a plurality of command functions can be realized relying upon the combination of the operation time and the number of times of operations in a manner that has been widely known.

To use the ETC car-mounted equipment, furthermore, the main body 13 of the car-mounted equipment is intimately attached to, and is held by, the existing room mirror in a vehicle of any model through the resilient holding units 21 and the holder rubbers 22, and is secured to the room mirror using the burglarproof metal fitting 23.

Therefore, unauthorized persons who have no special jig cannot remove the main body 13 of the car-mounted equipment without disassembling the room mirror. Accordingly, the ETC car-mounted equipment is not stolen.

Since the ETC car-mounted equipment can be attached to any existing room mirror, no special place needs be maintained in the dashboard for installing the ETC car-mounted equipment.

The antenna unit 15 is allowed to be turned in the directions of arrows P and R about the two shafts X and Y via the motion connection portions 25X and 25Y that form an angle-adjusting mechanism. Accordingly, despite the driver turns the mirror unit 14 together with the main body 13 of the car-mounted equipment to obtain a rear view after the main body 13 of the car-mounted equipment has been attached to the room mirror, it is allowed to adjust again the antenna unit 15 toward an optimum direction of communication irrespective of the turn of the mirror unit 14.

It is therefore allowed to maintain the directivity of the antenna by optimizing the direction of the antenna element 15A irrespective of the turn of the mirror unit 14 (room mirror).

Besides, the reflection-preventing lever of the existing room mirror protrudes through the hole 27 in the main body 13 of the car-mounted equipment, and the operability of the reflection-preventing lever is not impaired.

Embodiment 2.

In the above-mentioned embodiment 1, the openings 13B in the main body 13 of the car-mounted equipment were opened by inserting a special jig in order to liberate the burglarproof mechanism. It is, however, also allowable to form the locking pawls 23C of the burglarproof metal fitting 23 on the inner sides only, and to expand the protuberances 23B of the burglarproof metal fitting 23 by using a special jig.

In this case, as shown in FIGS. 4 and 5, the protuberances 23B of the burglarproof metal fitting 23 produce resiliency in the directions of arrows B (toward the inside), and the locking pawls 23C are provided on the inner sides only of the pair of protuberances 23B.

Therefore, the state where the locking pawls 23C and the openings 13B are engaged with each other, is liberated by inserting a special jig between the pair of protuberances 23B.

Embodiment 3.

In the above-mentioned embodiment 1, the width W of the mirror stay-engaging portion 23A of the burglarproof metal fitting 23 was variably set depending upon the shape of the stay of the room mirror. The width W, however, may be set to correspond to the shape of the stay by utilizing the resiliency of the mirror stay-engaging portion 23A.

In this case, the same burglarproof metal fitting 23 can be used within a predetermined range where the resiliency is produced, and there is no need to replace the burglarproof metal fitting 23 depending upon the model of the vehicle.

What is claimed is:

1. An ETC car-mounted equipment for exchanging ETC data relative to an ETC road equipment, comprising;

a main body of the car-mounted equipment having a display unit for displaying the ETC data;

an IC card insertion port formed in the main body of said car-mounted equipment and in which will be inserted an IC card that stores said ETC data;

a mirror unit provided on the front surface of the main body of said car-mounted equipment;

an antenna unit provided on the back surface side of the main body of said car-mounted equipment; and resilient holding units for holding the main body of said car-mounted equipment on a room mirror in said vehicle integrally therewith.

2. An ETC car-mounted equipment according to claim 1, wherein the main body of said car-mounted equipment has holder rubbers which are disposed being opposed to said resilient holding units to hold said room mirror.

3. An ETC car-mounted equipment according to claim 1, further comprising a burglarproof mechanism for securing the main body of said car-mounted equipment to the room mirror.

4. An ETC car-mounted equipment according to claim 3, wherein said burglarproof mechanism includes openings formed in the main body of said car-mounted equipment and a burglarproof metal fitting, and said burglarproof metal fitting includes:

a mirror stay-engaging portion that engages with the stay of said room mirror;

protuberances inserted in the openings in the main body of said car-mounted equipment; and locking pawls provided at portions of said protuberances to engage with said openings.

5. An ETC car-mounted equipment according to claim 4, wherein said mirror stay-engaging portion has a U-shape of which the width can be variably set depending upon the shape of said stay.

6. An ETC car-mounted equipment according to claim 4, wherein the openings of the main body of said car-mounted equipment produce resiliency in the opening/closing direction, and the state of engagement between the locking pawls of said burglarproof metal fitting and the openings in the main body of said car-mounted equipment, is liberated by inserting a special jig in said openings.

7. An ETC car-mounted equipment according to claim 4, wherein the protuberances of said burglarproof metal fitting comprise a pair of protuberances that produce resiliency toward the inside, said locking pawls are provided on the inside only of each of said pair of protuberances, and the state of engagement between the locking pawls of said burglarproof metal fitting and the openings in the main body of said car-mounted equipment, is liberated by inserting a special jig between said pair of protuberances.

8. An ETC car-mounted equipment according to claim 1, wherein an antenna-mounting portion for mounting said antenna unit on the main body of said car-mounted equipment, includes an antenna angle-adjusting mechanism for adjusting the direction of communication of said antenna unit.

9. An ETC car-mounted equipment according to claim 8, wherein said antenna angle-adjusting mechanism includes at least a front direction angle-adjusting shaft and a side direction angle-adjusting shaft for turning the communication plane of said antenna unit in the directions of a plurality of axes with respect to the direction in which the vehicle travels.

10. An ETC car-mounted equipment according to claim 1, wherein said display unit is arranged at a lower part on the front surface of the main body of said car-mounted equipment, and has key switches on both sides thereof for inputting the data.

11. An ETC car-mounted equipment according to claim 1, wherein the main body of said car-mounted equipment has a hole through which a reflection-preventing lever of said room mirror protrudes so as to be operated.

* * * * *